US012692707B2

(12) United States Patent
Lane

(10) Patent No.: US 12,692,707 B2
(45) Date of Patent: Jul. 28, 2026

(54) STANDING AWNING STRUCTURE

(71) Applicant: James Patrick Lane, Lake Mary, FL (US)

(72) Inventor: James Patrick Lane, Lake Mary, FL (US)

( * ) Notice: Subject to any disclaimer, the term of this patent is extended or adjusted under 35 U.S.C. 154(b) by 640 days.

(21) Appl. No.: 18/135,982

(22) Filed: Apr. 18, 2023

(65) Prior Publication Data

US 2023/0374789 A1 Nov. 23, 2023

Related U.S. Application Data

(60) Provisional application No. 63/331,965, filed on Apr. 18, 2022.

(51) Int. Cl.
*E04F 10/04* (2006.01)
*E04H 15/58* (2006.01)

(52) U.S. Cl.
CPC ..... *E04F 10/04* (2013.01); *E04H 15/58* (2013.01)

(58) Field of Classification Search
CPC ..... E04F 10/04; E04H 15/58; E04H 15/44
See application file for complete search history.

(56) References Cited

U.S. PATENT DOCUMENTS 498,583 A * 5/1893 Bowser et al. ..... B62C 5/04 135/96
1,150,764 A * 8/1915 Hocking et al. ..... E04H 15/48 5/130
1,593,431 A * 7/1926 Buie ..... E04H 15/58 135/900
2,002,296 A * 5/1935 Pope ..... A45B 17/00 135/912
3,221,756 A * 12/1965 Rupright ..... A47B 37/04 135/147
3,383,127 A * 5/1968 Grunfeld ..... F16B 7/00 135/96
3,890,989 A * 6/1975 Kuxhouse ..... A45B 25/02 135/96
4,558,713 A * 12/1985 Hagler ..... E04H 15/34 135/159
4,724,882 A * 2/1988 Wang ..... E04H 15/58 211/195

(Continued)

*Primary Examiner* — David R Dunn
*Assistant Examiner* — Danielle Jackson
(74) *Attorney, Agent, or Firm* — ALLEN, DYER, DOPPELT + GILCHRIST, P.A.

(57) ABSTRACT

A standing awning structure includes a first top support member, and a second top support member substantially parallel to the first top support member. The structure also includes a first cross member spanning between the first and the second top support members, and a second cross member spanning between the first and the second support members. A sheet of fabric is stretched between the first and the second cross members. In addition, the structure includes a plurality of collars slid over the first and the second top support members, a first brace assembly connected to the first top support member using the plurality of collars, and a second brace assembly connected to the second top support member using the plurality of collars. The structure includes a first vertical post connected to the first brace assembly, and a second vertical post connected to the second brace assembly.

15 Claims, 13 Drawing Sheets

(56) References Cited

U.S. PATENT DOCUMENTS

| | | | | |
|---|---|---|---|---|
| 5,185,972 | A * | 2/1993 | Markiewicz | E04H 15/58 52/63 |
| 5,579,796 | A | 12/1996 | Mallo et al. | |
| 7,896,015 | B2 * | 3/2011 | Milano, Jr. | E04H 15/06 135/117 |
| 7,913,710 | B2 | 3/2011 | Bougioukos | |
| 9,683,386 | B1 | 6/2017 | Morrison | |
| D802,797 | S | 11/2017 | Morrison | |
| 10,151,120 | B1 | 12/2018 | Kaneshiro | |
| 10,477,930 | B2 * | 11/2019 | Kuypers | A45B 23/00 |
| 10,947,735 | B2 | 3/2021 | Auer | |
| 2015/0376901 | A1 | 12/2015 | Patridge et al. | |
| 2016/0368571 | A1 | 12/2016 | Levin | |
| 2018/0132658 | A1 | 5/2018 | Young | |

* cited by examiner

STANDING AWNING STRUCTURE

RELATED APPLICATIONS

The present invention is related to U.S. Provisional Patent Application Ser. No. 63/331,965 filed Apr. 18, 2022, the entire contents of which are incorporated herein by reference.

TECHNICAL FIELD

The present invention relates to the field of shade awnings, and, more particularly, to a standing awning structure.

BACKGROUND

Awnings are typically used as an architectural feature to define an open outdoor sitting space that offers protection and shade from the sun. The awnings typically have a roof or canopy that extends from a building or support structure. Free standing awnings include their own support structure that can be installed in a desired location on a patio or pool deck, for example. The free standing awnings typically include vertical supports that support the roof. The vertical supports may be movable or permanently secured to the ground using concrete or bolts, for example. The roof may be constructed of a rigid sheet material or a fabric stretched tight.

The existing free standing awnings require long posts and other structural elements that are heavy and cumbersome to handle. This in turn increases shipping costs due to the shape and weight of the awning and associated structure. Accordingly, there is a need for an awning that is easy to assemble and also is relatively inexpensive to ship.

SUMMARY

A standing awning structure is disclosed. The structure includes a first top support member, and a second top support member substantially parallel to the first top support member. The structure also includes a first cross member spanning between the first and the second top support members, and a second cross member spanning between the first and the second support members. The second support member is spaced apart from the first cross member and a sheet of fabric is stretched between the first and the second cross members. In addition, the structure includes a plurality of collars slid over the first and the second top support members, a first brace assembly connected to the first top support member using the plurality of collars, and a second brace assembly connected to the second top support member using the plurality of collars. The structure includes a first vertical post connected to the first brace assembly, and a second vertical post connected to the second brace assembly.

The first top support member may comprise two elements joined together using a first inner coupling, and the second top support member may also comprise two elements joined together using a second inner coupling. A first footer pipe may be connected to the first vertical post, and a second footer pipe connected to the second vertical post.

The structure may also include a first pair of cross member connectors and a second pair of cross member connectors, wherein the first and second pair of cross member connectors secure ends of the first and second cross members to the first and second top support members, respectively. Each cross member connector may include a billet and a slide, wherein the slide is secured to a respective top support member and the billet is inserted into a respective cross member.

The plurality of collars may include a first three-way collar connecting the first top support member to the first brace assembly, and a second three-way collar connecting the second top support member to the second brace assembly. The first brace assembly may comprise a first center brace, a first front brace, and a first rear brace, that extend from the first three-way collar to the first top support member. The second brace assembly may also comprise a second center brace, a second front brace, and a second rear brace, that extend from the second three-way collar to the second top support member.

The slide of each cross member connector may include a slot configured to receive a bolt therethrough to adjustably secure the cross member connector to the respective top support member.

The first and the second top support members, the first and the second cross members, and the first and the second brace assemblies may comprise individual components having linear dimensions no greater than four feet in length when disassembled. In addition, at least one of the first and second top support members, the first and the second cross members, and the first and the second brace assemblies are comprised of tubular material.

In another aspect, a method of making a standing awning structure is disclosed. The method includes coupling together two structural elements to form a first side of an awning frame, and coupling together two structural elements to for a second side of the awning frame. The method also includes coupling together two structural elements to form a first cross member of the awning frame, and coupling together two structural elements to form a second cross member of the awning frame. In addition, the method includes sliding a first plurality of collars over the first side of the awning frame, and sliding a second plurality of collars over the second side of the awning frame. The method includes stretching a sheet of fabric between the first and second cross members, and coupling the first and the second cross members between the first and second sides of the awning frame. The method also includes coupling a first brace assembly having an upper end to the first plurality of collars, and connecting a second brace assembly having an upper end to the second plurality of collars. The method includes coupling a first vertical post to a lower end of the first brace assembly, and coupling a second vertical post connected to a lower end of the second brace assembly, wherein the first and second vertical supports provide a foundation to support the awning frame substantially horizontal.

Other aspects, advantages, and features of the present disclosure will become apparent after review of the entire application, including the following sections: Brief Description of the Drawings, Detailed Description, and the Claims.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. In addition, many elements described herein may only be described for one side of the standing awning structure for clarity. As those of ordinary skill in the art can appreciate, the description applies to similar and duplicative components on the other portions of the standing awning structure as well as shown in the various drawings.

Figure 1:
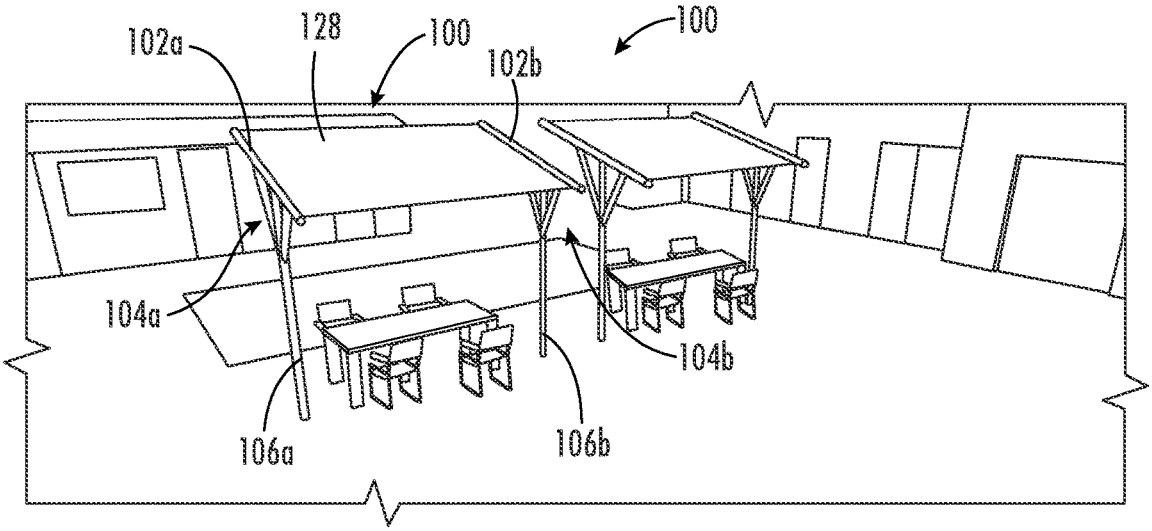
FIG. 1 is a rear perspective view of a standing awning structure in which various aspects of the disclosure may be implemented.
Figure 2:
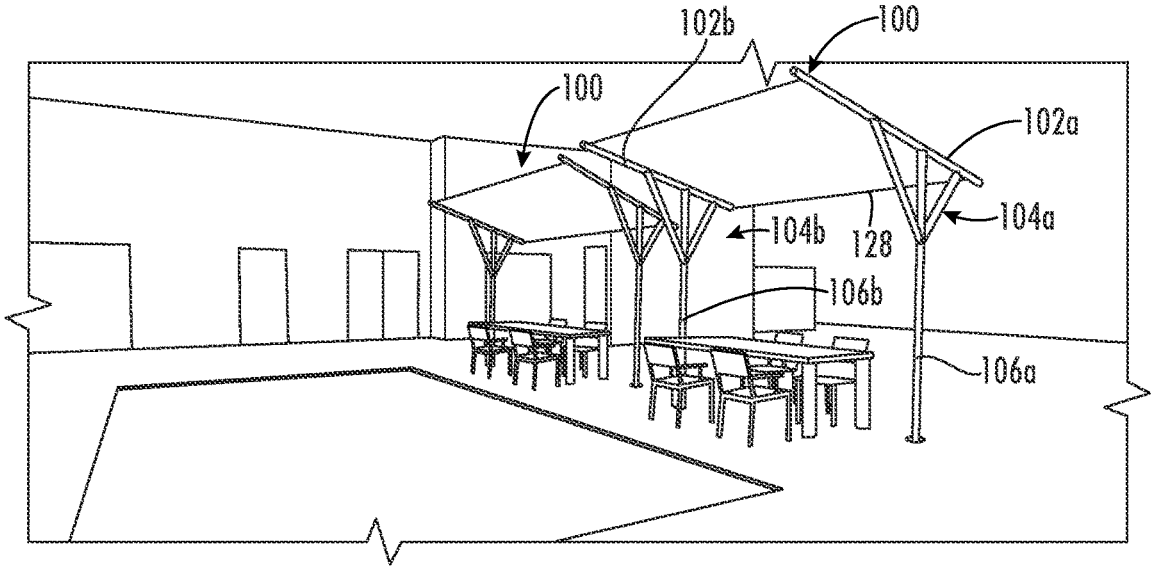
FIG. 2 is a front perspective view of the standing awning structure.

Referring now to FIGS. 1 and 2, a pair of standing awning structures are shown mounted to a pool deck. The standing awning structures are generally designated 100 and in which various aspects of the disclosure may be implemented. Each of the standing awning structures 100 includes a top support member 102*a*, 102*b*, a brace assembly 104*a*, 104*b*, and a footer assembly 106*a*, 106*b*. The roof or canopy of the standing awning structure 100 comprises a sheet of fabric 128 stretched between the top support members 102*a*, 102*b* using cross members as discussed below.

Figure 3:
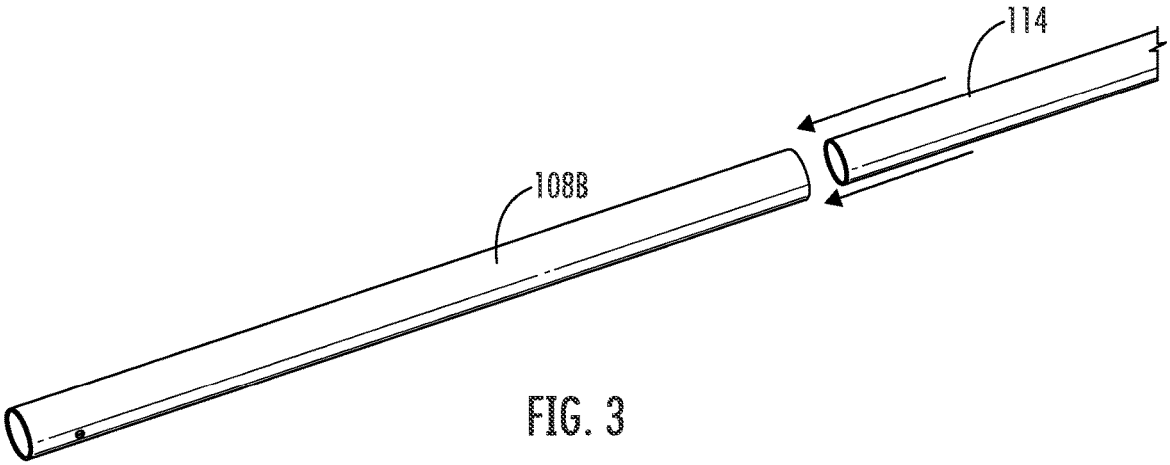
FIGS. 3 and 4 are perspective views of a top support member of the standing awning structure of FIG. 1.
Figure 4:
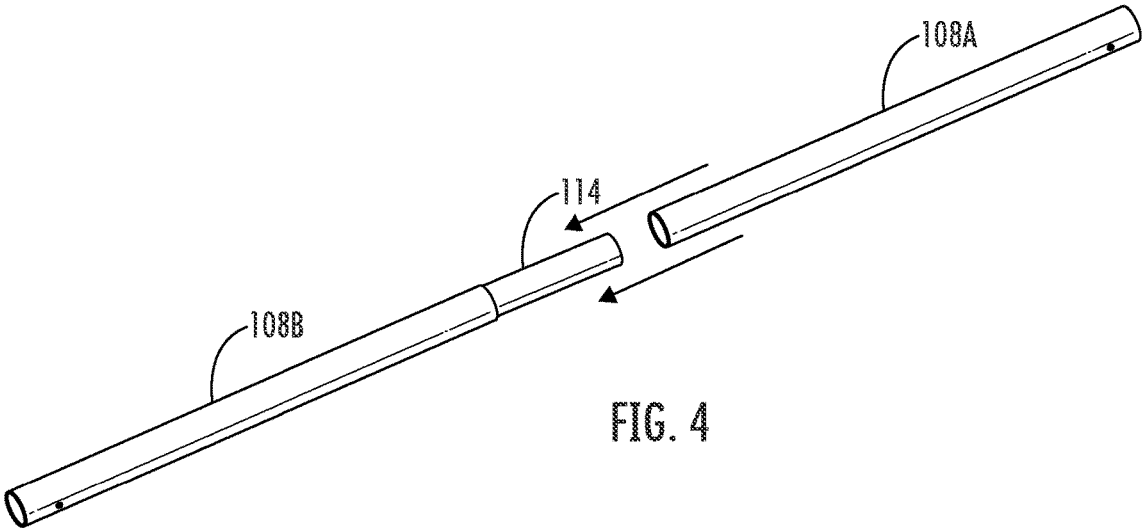

FIGS. 3 and 4 show how the pieces 108*a* and 108*b* are joined together using a smaller diameter inner coupling 114 to form longer top support members 102*a*, 102*b*. The inner coupling 114 is inserted halfway into piece 108*b* as shown in FIG. 3, and piece 108*a* is slid over the other half of the inner coupling 114 as shown in FIG. 4. This allows the top support members 102*a*, 102*b* to be broken down and shipped in a smaller dimensional package compared to shipping the top support members 102*a*, 102*b* at their assembled length. The inner coupling 114 may be secured into either piece 108*a*, 108*b* for shipping or may be separate to keep a length of each piece 108*a*, 108*b* to a minimum. One advantage of the standing awning structure 100 is the feature of the components to be shipped in relatively small packages that have a length much shorter than their fully assembled length.

Figure 5:
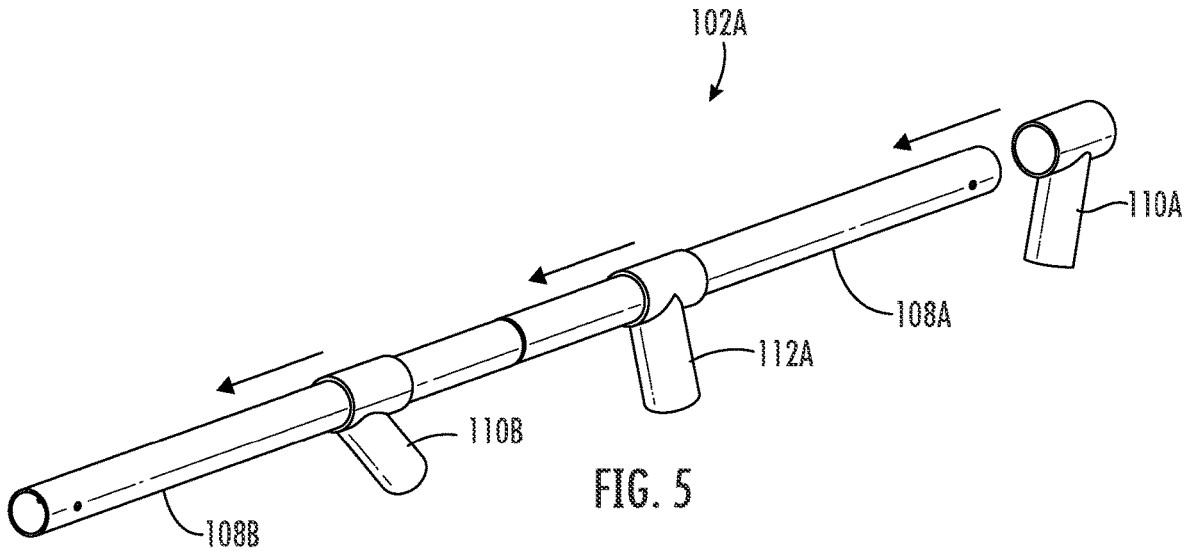
FIG. 5 is a perspective view of sliding a plurality of collars onto the top support member of FIG. 4.

Once the top support members 102*a*, 102*b* are assembled, a plurality of collars 110*a*, 110*b*, and 112*a* are slid on to the respective top support member as shown in FIG. 5. Collars 110*a* and 110*b* include a first tubular section that slides over the top support members 102*a*, 102*b*, and a second tubular section that that depends from the first tubular section at an angle. A center collar 112*a* also includes a first tubular section that slides over the top support members 102*a*, 102*b*, and a second tubular section that depends from and may be perpendicular to the first tubular section.

Figure 6:
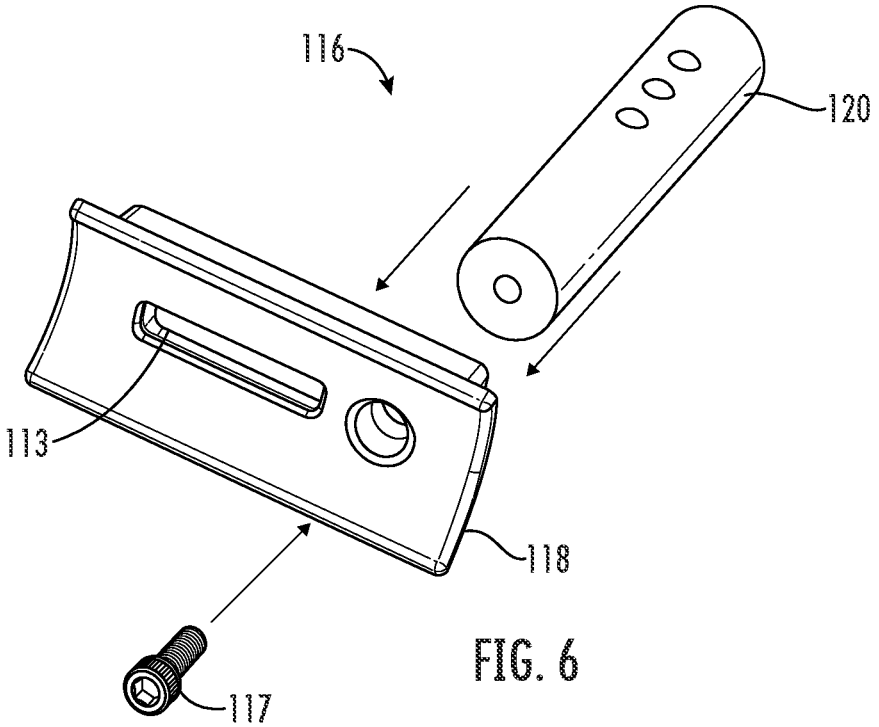
FIG. 6 is a perspective view of a cross member connector.
Figure 7:
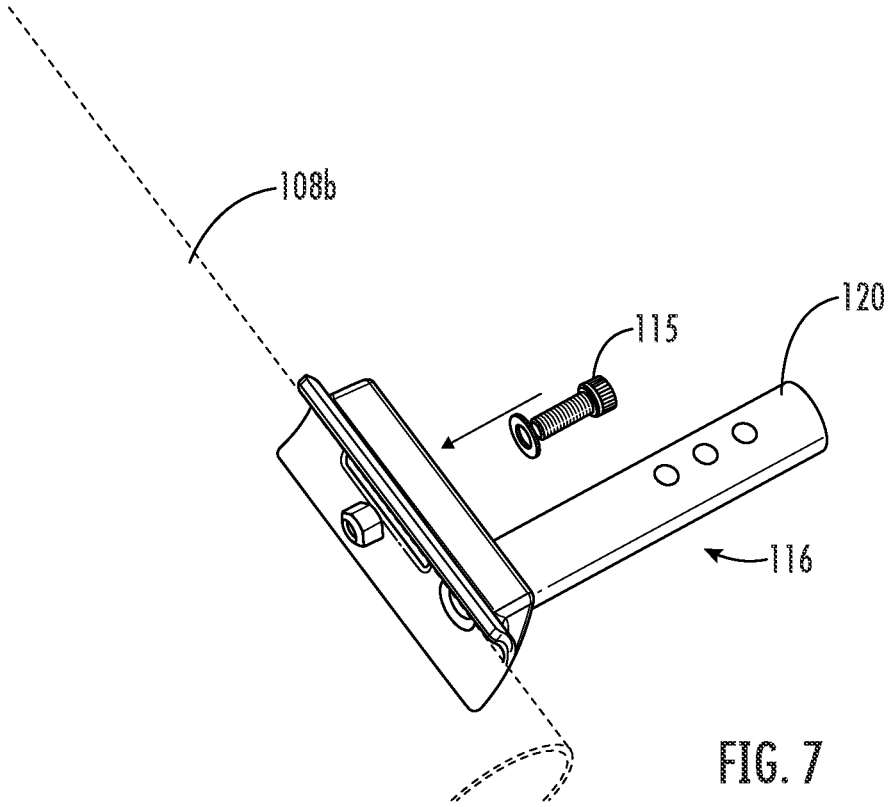
FIG. 7 is a perspective view of the cross member connector being connected to the top support member.

A cross member connector 116 is assembled and secured to the top support members proximate the respective ends thereof as shown in FIGS. 6 and 7. The cross member connector 116 includes a billet 120 and a slide 118. The slide 118 also includes a slot 113. In particular, the billet 120 is secured to the slide 118 using bolt 117. The connector 116 is secured to the piece 108*b* using bolt and washer 115. The bolt 115 fits through the slot 113 of the slide 118 and is secured to an aperture in piece 108*b* by a nut on the inside of the piece 108*b*. Accordingly, the bolt 115 can be loosened so that the bolt 115 holding the connector 116 to the piece 108*b* can slide within the slot 113 of the connector 116. Thus, the connector 116 can in turn slide along the piece 108*b* to increase the tension and tighten the sheet of fabric 128 as described below. Then that bolt 115 may be tightened to secure the connector 116 in position on the piece 108*b* with the sheet of fabric 128 taut.

Figure 8:
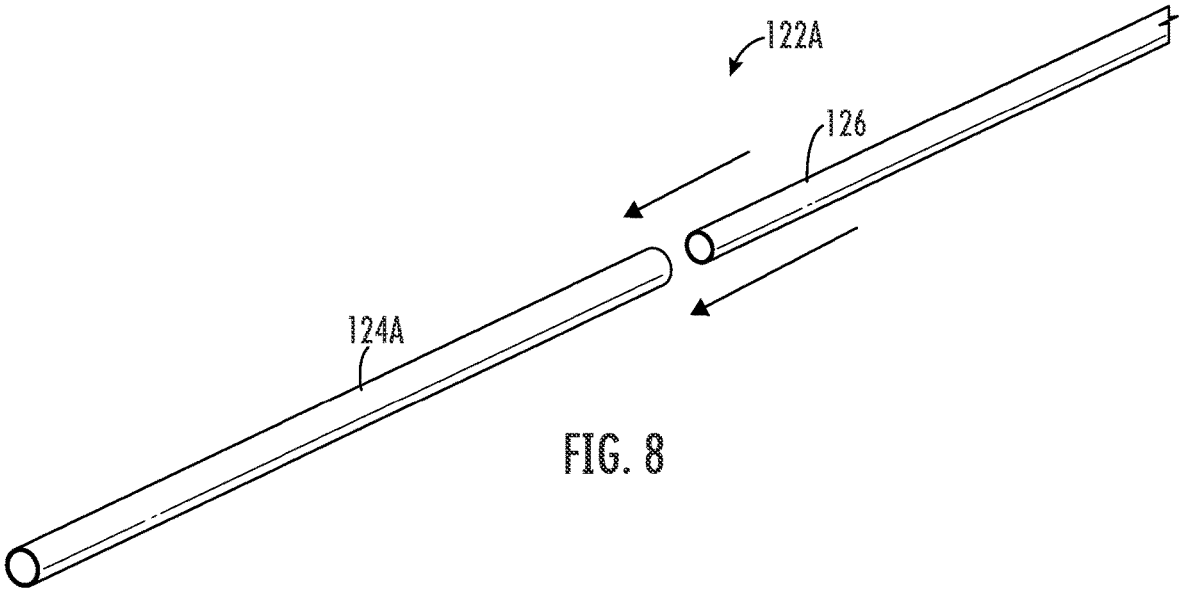
FIGS. 8 and 9 are perspective views of a cross member.
Figure 9:
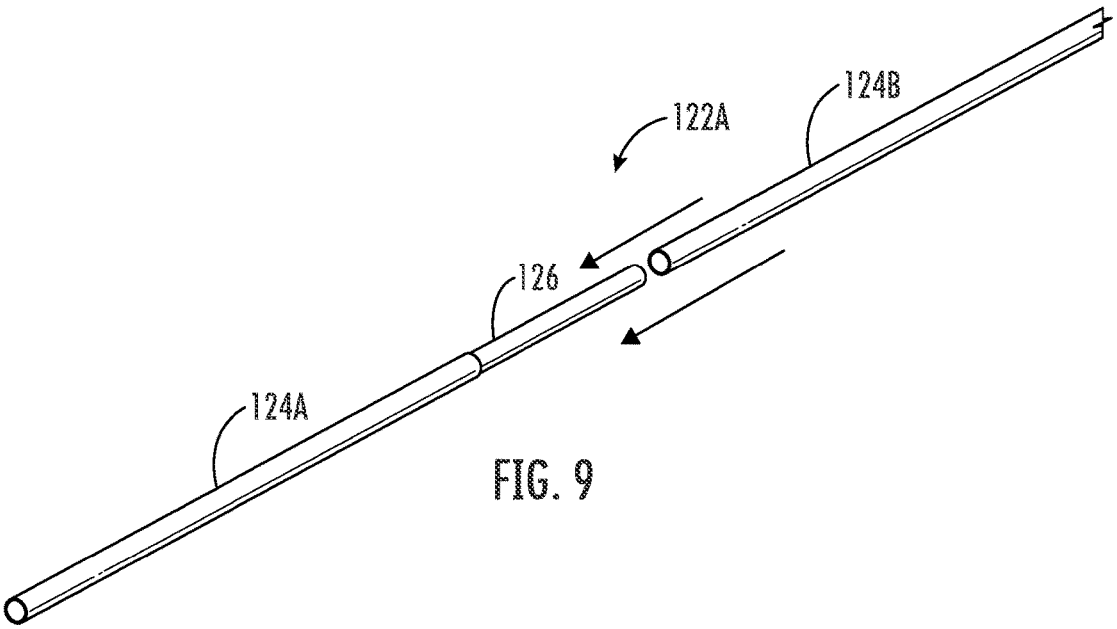

Referring now to FIGS. 8 and 9, pieces 124*a* and 124*b* pieces are joined together using a small diameter inner coupling 126 to form longer cross members 122*a*, 122*b*. This allows the cross members 122*a*, 122*b* to be broken down and shipped in a smaller dimensional package similar to the top support members. The inner coupling 126 is inserted halfway into piece 124*a*. The piece 124*b* is then slid over the other half of the inner coupling 126.

Figure 10:
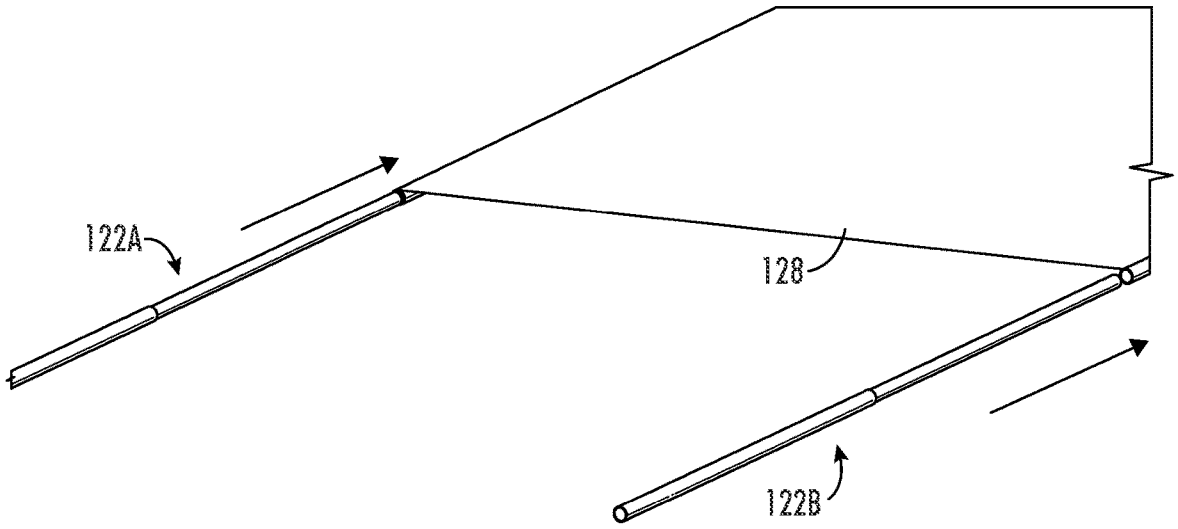
FIG. 10 is a perspective view of the cross members being inserted into a fabric roof of the standing awning structure.

Referring now to FIG. 10, the cross members 122*a*, 122*b* are inserted into, or otherwise secured to, opposing edges of the sheet of fabric 128 of the standing awning structure 100. The sheet of fabric 128 that forms the roof or canopy may include longitudinal pockets sewn proximate the respective edges of the sheet of fabric 128 configured for the cross members 122*a*, 122*b*.

Figure 11:
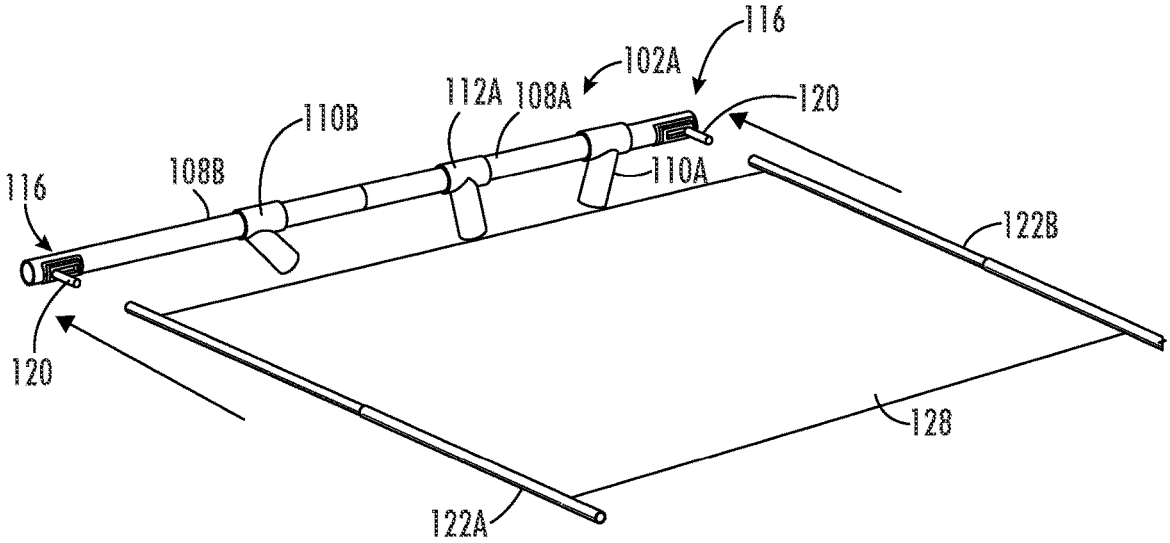
FIGS. 11 and 12 are perspective views of the cross members being connected to the top support members.
Figure 12:
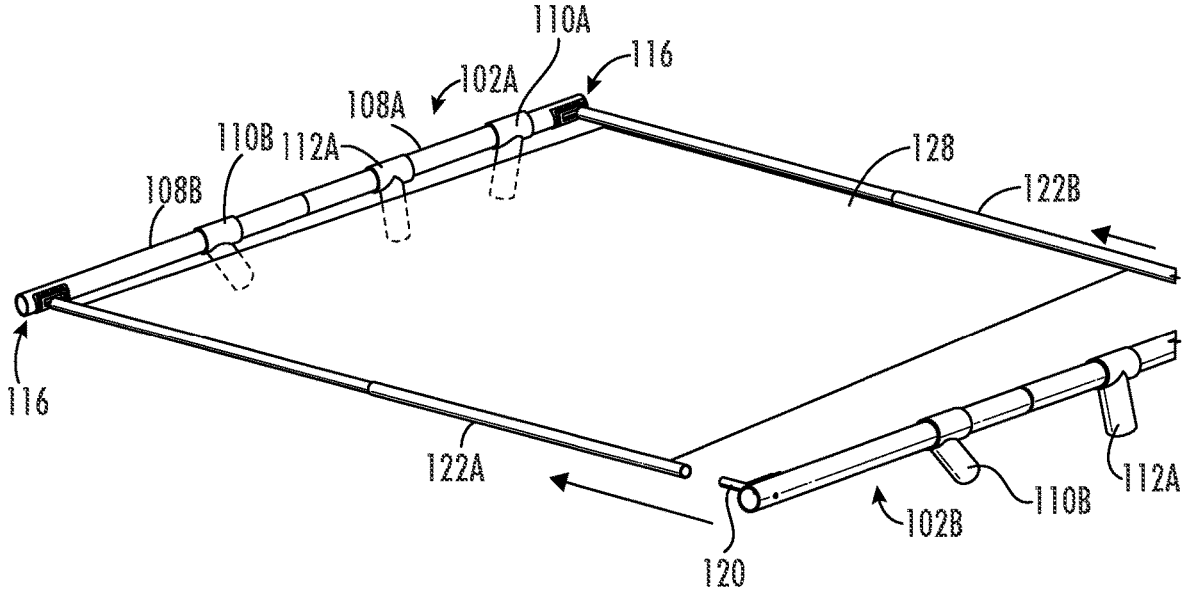

The cross members 122*a*, 122*b* are secured between the top support members 102*a*, 102*b* as shown in FIGS. 11 and 12. In particular, a first end of cross member 122*a* is slid over the billet 120 of the respective cross member connector 116 secured to the top support member 102*a*. Similarly, a first end of cross member 122*b* is slid over the billet 120 of the respective cross member connector 116 proximate an opposing end of the top support member 102*a* as shown in FIG. 11. The opposing ends of the respective cross members 122A, 122B are secured similarly to the opposing top support member 102*b* as shown in FIG. 12.

Figure 13:
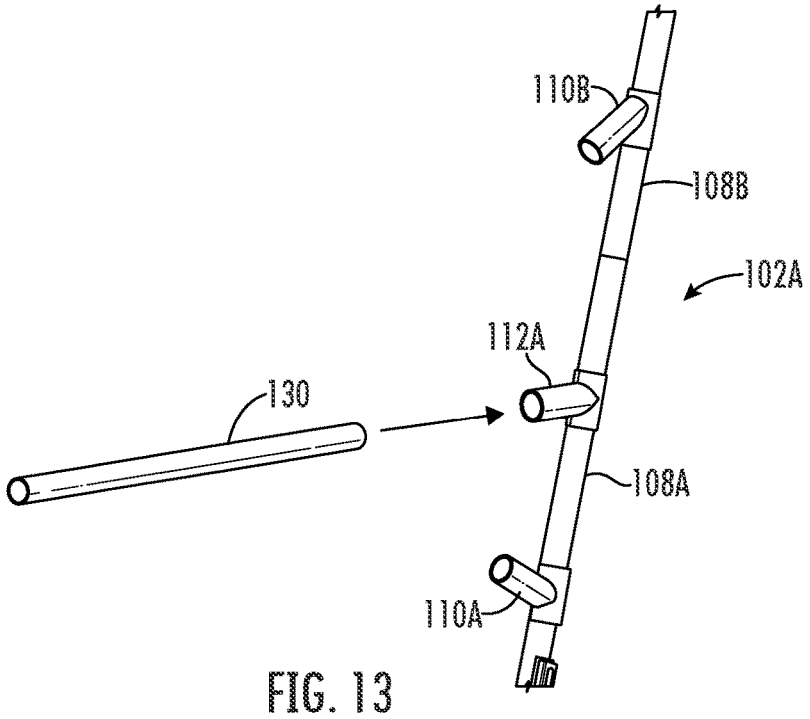
FIG. 13 is a perspective view of a first portion of a vertical support member of the standing awning structure of FIG. 1 being connected to the top support member.
Figure 14:
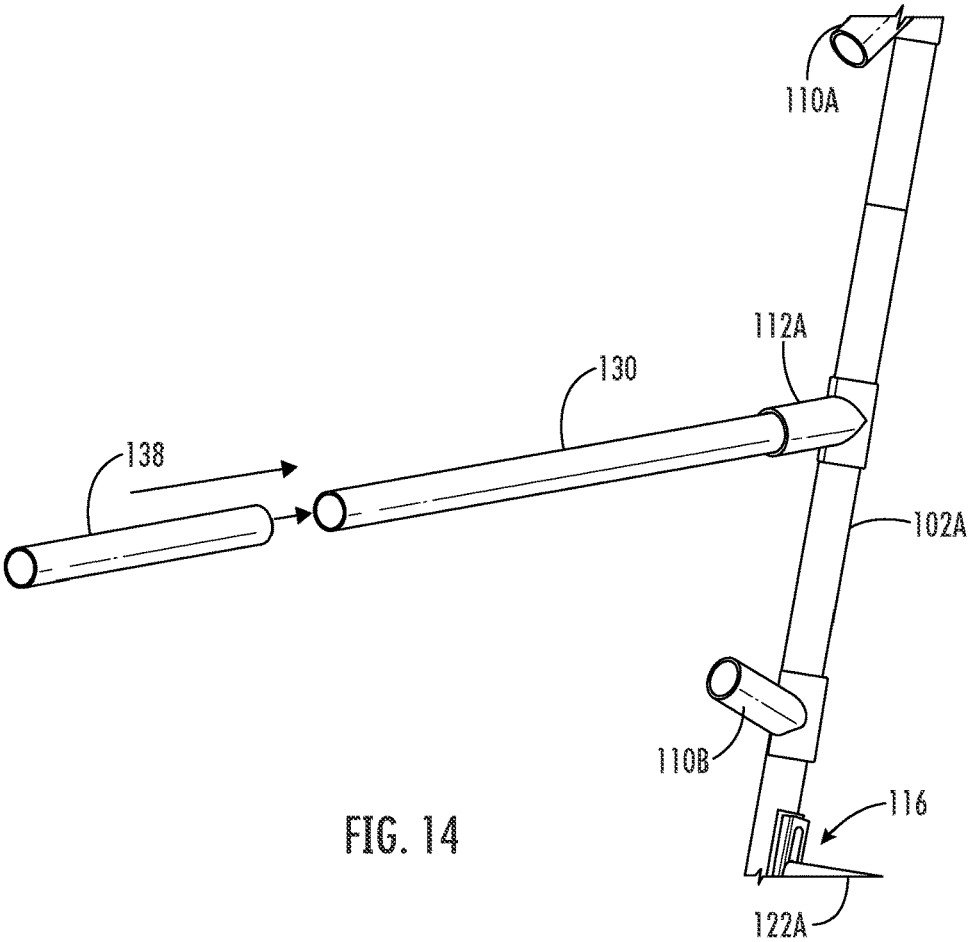
FIG. 14 is a perspective view of an inner coupling being inserted into the first portion of the vertical support member.
Figure 15:
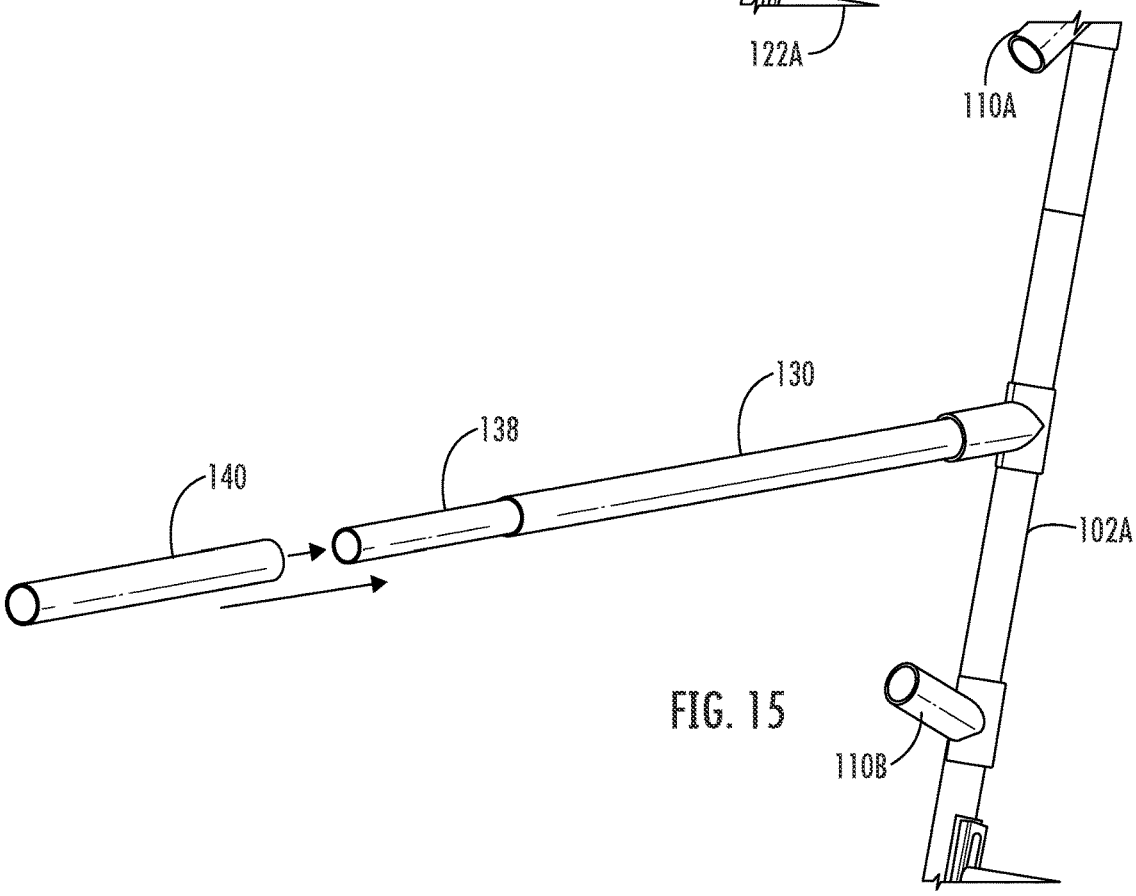
FIG. 15 is perspective view of the inner coupling being inserted into a second portion of the vertical support member.

Referring now to FIGS. 13-18, the brace assemblies 104*a*, 104*b* are shown through the assembly process and connection to the top support members 102*a*, 102*b*. Element 130 is inserted into collar 112*a* as shown in FIG. 13. An inner coupling 138 is inserted halfway into an opposing end of element 130 as shown in FIG. 14. Element 140 is slid over the other half of inner coupling 138 to form a vertical support as shown in FIG. 15.

Figure 16:
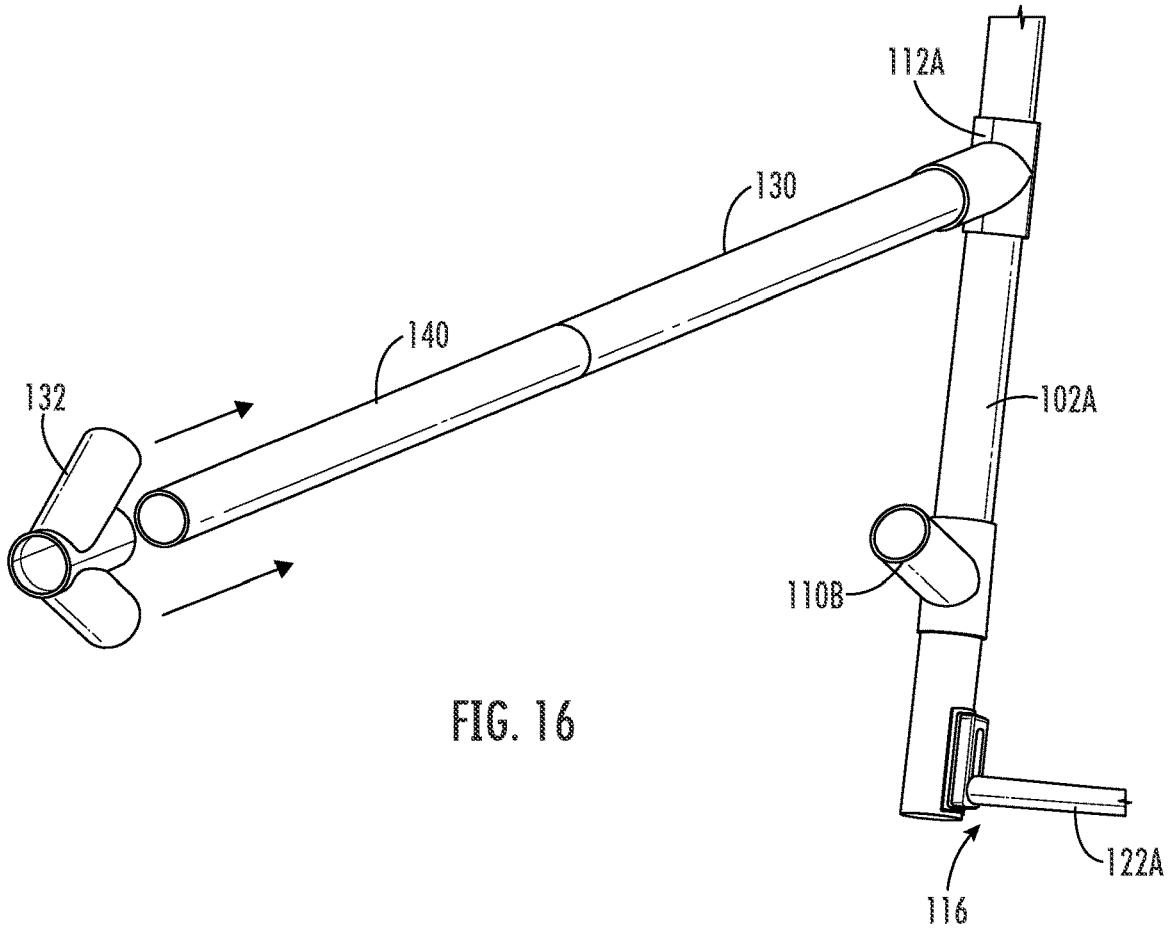
FIG. 16 is a perspective view of a "W" collar being connected to the vertical support member of a brace assembly.
Figure 17:
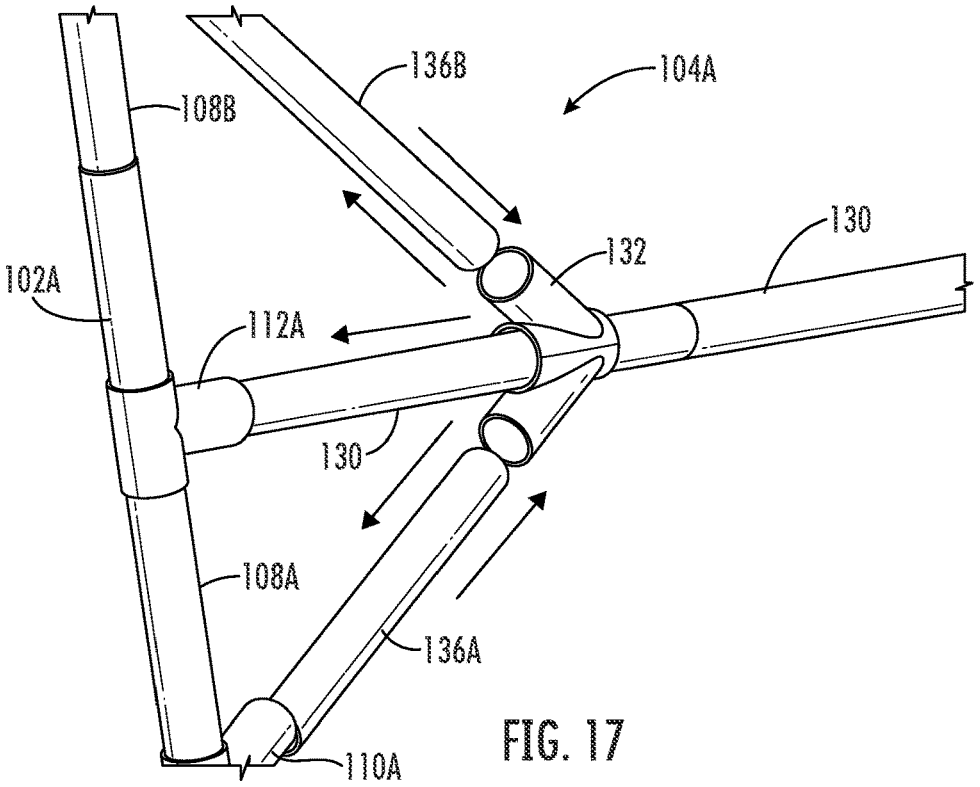
FIGS. 17 and 18 are perspective views of the brace assembly being connected to the top support member.
Figure 18:
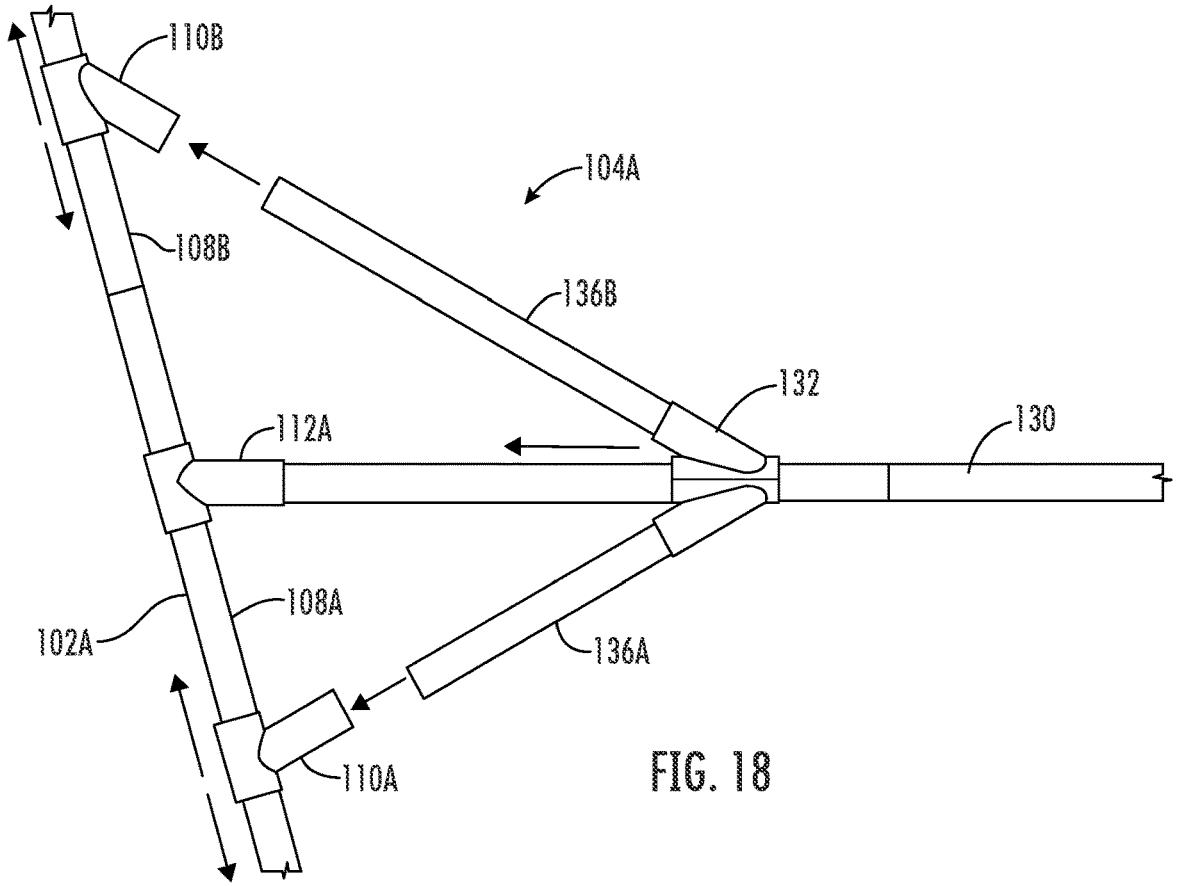

A "w" collar 132 is slid over element 140 and up towards element 130 as shown in FIG. 16. Element 136*a* is inserted into collar 110*a* and "w" collar 132 and, similarly, element 136*b* is inserted into collar 110*b* and "w" collar 132 to form the brace assembly 104*a* as shown in FIGS. 17 and 18

Figure 19:
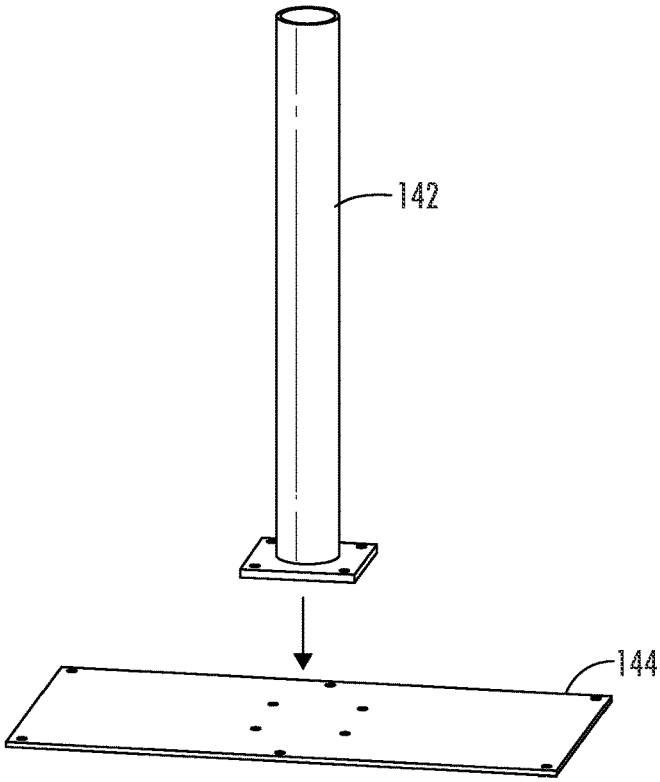
FIG. 19 is a perspective view of a footer assembly of the standing awning structure of FIG. 1.
Figure 20:
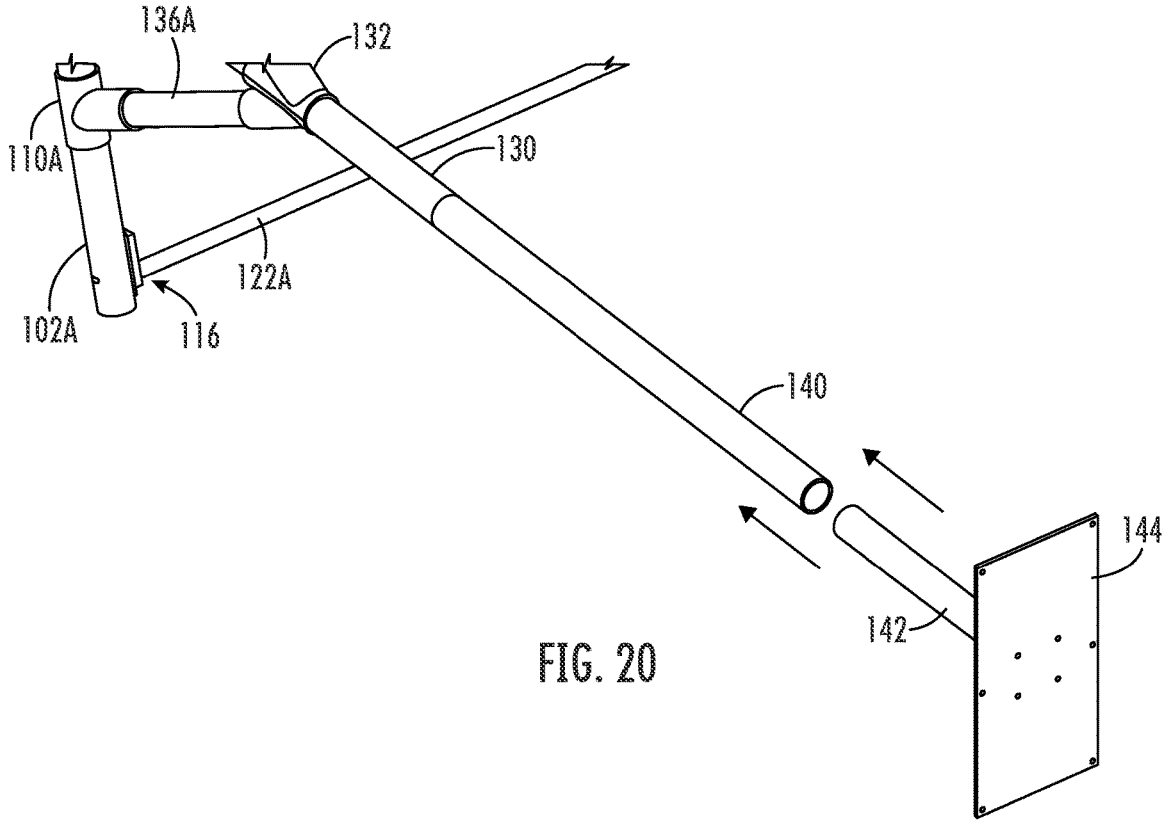
FIG. 20 is a perspective view of the footer assembly being connected to the brace assembly.

Referring now to FIGS. 19 and 20, the footer assembly is shown being assembled where a plate 144 is secured to the bottom of a footer pipe 142. The footer pipe 142 is configured to be slid into an open end of the element 140 and will be used to support the standing awning structure 100 in an upright position.

Figure 21:
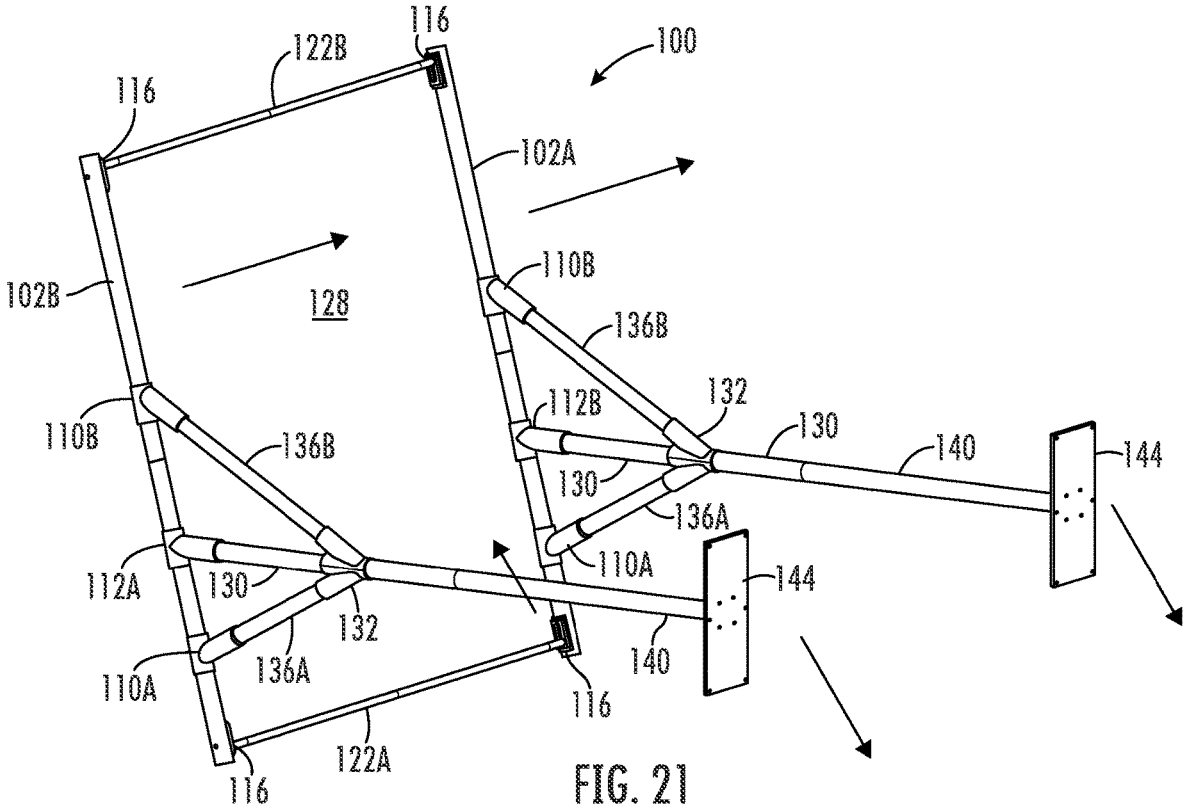
FIG. 21 is a bottom perspective view of the assembled standing awning structure of FIG. 1.

Once the standing awning structure 100 is fully assembled as shown in FIG. 21, it can be rotated up and secured to a footing or deck, for example, using bolts or other type of fasteners or anchoring system. A bottom perspective view of the fully assembled standing awning structure 100 is shown in FIG. 21.

Figure 22:
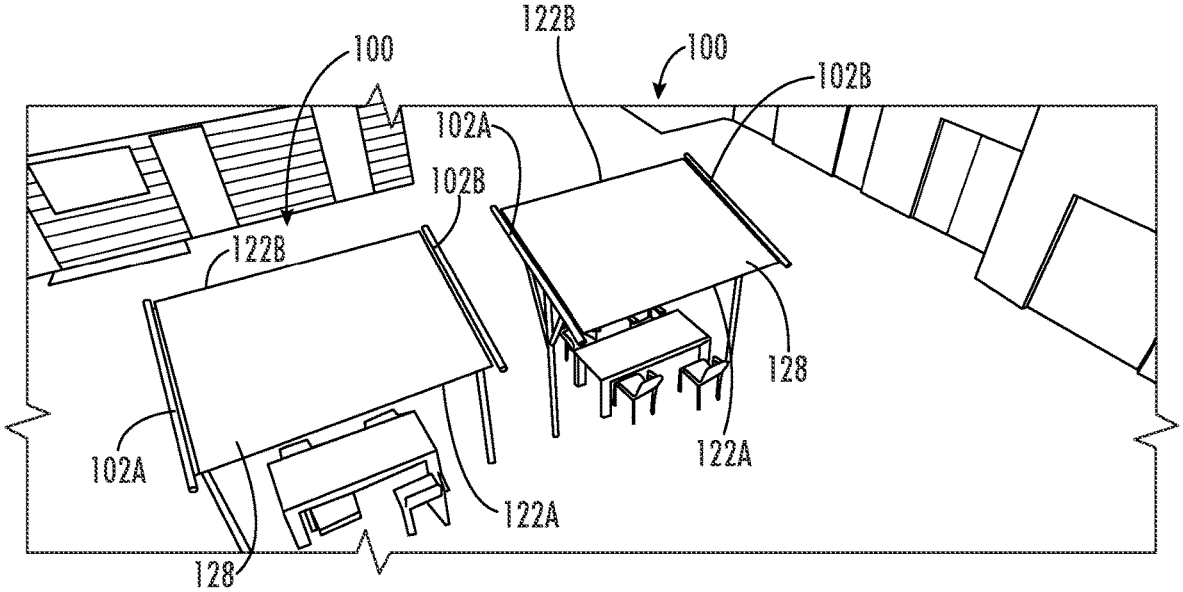
FIG. 22 is a top perspective view of the standing awning structures on a pool deck.

FIG. 22 is a top perspective showing two of the fully assembled standing awning structures 100 secured to the pool deck and next to the pool. As those of ordinary skill in the art can appreciate, the dimensions may vary as well as the shape of the standing awning structure.

Figure 23:
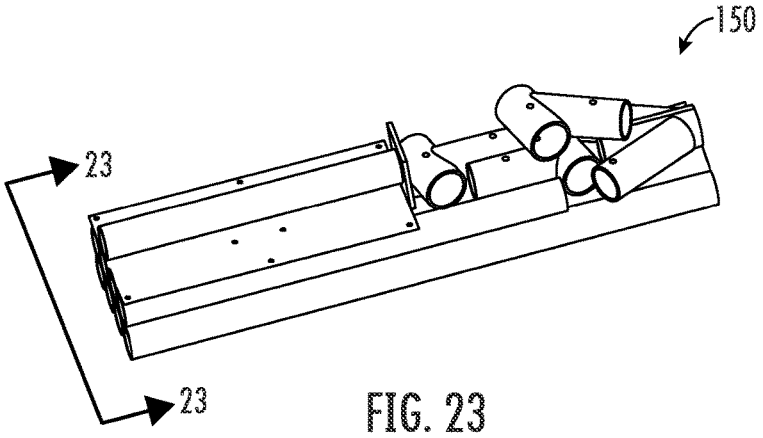
FIG. 23 is a perspective view of the footer assembly and the brace assembly packaged for shipping.
Figure 24:
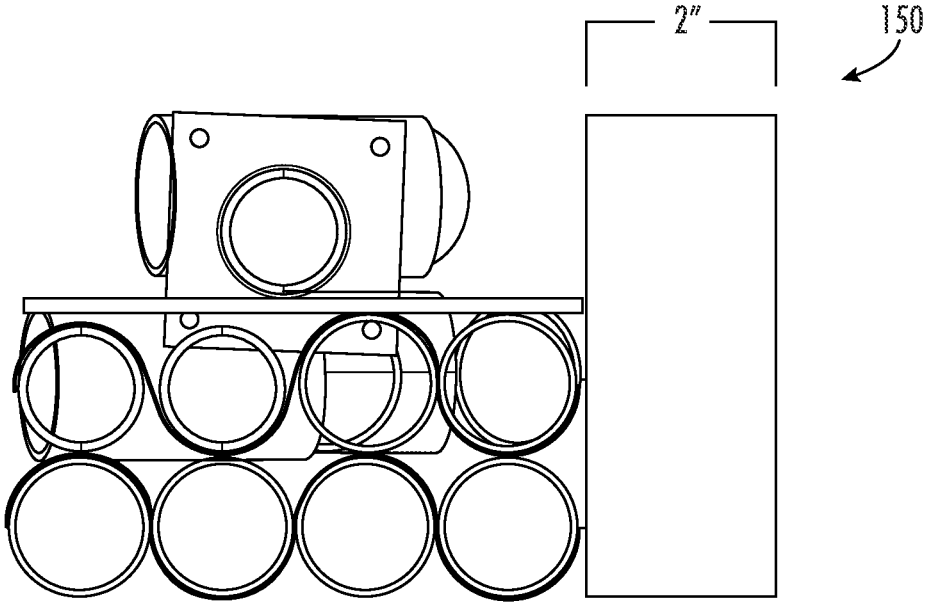
FIG. 24 is an elevational view of the footer assembly and the brace assembly packaged for shipping.
Figure 25:
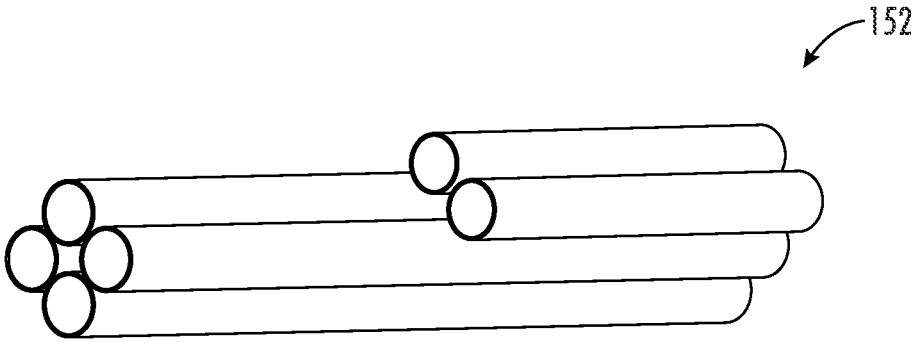
FIG. 25 is a perspective view of the cross members packaged for shipping.

Referring now to FIGS. 23 and 24, the brace assembly and the footer assembly of the standing awning structure are configured to be shipped in a relatively compact package 150. Similarly, the top support members are also configured to be shipped in a compact package 152 as shown in FIG. 25.

The previous description of the disclosed embodiments is provided to enable any person skilled in the art to make or use the disclosed embodiments. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope possible consistent with the principles and novel features as defined herein.

That which is claimed is:

1. A standing awning structure comprising:

a first top support member, and a second top support member substantially parallel to the first top support member;

a first cross member spanning between the first and the second top support members, and a second cross member spanning between the first and the second support members, the second support member spaced apart from the first cross member;

a plurality of collars slid over the first and the second top support members;

a first brace assembly connected to the first top support member using the plurality of collars;

a second brace assembly connected to the second top support member using the plurality of collars;

a first vertical post connected to the first brace assembly;

a second vertical post connected to the second brace assembly; and a first pair of cross member connectors and a second pair of cross member connectors, wherein the first and second pair of cross member connectors secure ends of the first and second cross members to the first and second top support members, respectively;

wherein each cross member connector comprises a billet and a slide, wherein the slide is secured to a respective top support member and the billet is inserted into a respective cross member.

2. The standing awning structure of claim 1, further comprising a sheet of fabric stretched between the first and the second cross members.

3. The standing awning structure of claim 2, wherein the first top support member comprises two elements joined together using a first inner coupling.

4. The standing awning structure of claim 3, wherein the second top support member comprises two elements joined together using a second inner coupling.

5. The standing awning structure of claim 4, further comprising a first footer pipe connected to the first vertical post, and a second footer pipe connected to the second vertical post.

6. The standing awning structure of claim 1, further comprising a first three-way collar connecting the first brace assembly to the first vertical post, and a second three-way collar connecting the second brace assembly to the second vertical post.

7. The standing awning structure of claim 6, wherein the first brace assembly comprises a first center brace, a first front brace, and a first rear brace, that extend from the first three-way collar to the first top support member.

8. The standing awning structure of claim 7, wherein the second brace assembly comprises a second center brace, a second front brace, and a second rear brace, that extend from the second three-way collar to the second top support member.

9. The standing awning structure of claim 8, wherein the slide of each cross member connector comprises a slot configured to receive a bolt therethrough to adjustably secure the cross member connector to the respective top support member.

10. The standing awning structure of claim 9, wherein the first and the second top support members, the first and the second cross members, and the first and the second brace assemblies are comprised of individual components having linear dimensions no greater than four feet in length when disassembled.

11. The standing awning structure of claim 10, wherein at least one of the first and second top support members, the first and the second cross members, and the first and the second brace assemblies are comprised of tubular material.

12. A standing awning structure comprising:

an awning frame having a first side and an opposing second side;

a sheet of fabric stretched between the awning frame;

a first plurality of collars slid over the first side of the awning frame, and a second plurality of collars slid over the second side of the awning frame;

a first brace assembly having an upper end connected to the first plurality of collars, and a second brace assembly having an upper end connected to the second plurality of collars; and a first vertical post connected to a lower end of the first brace assembly, and a second vertical post connected to a lower end of the second brace assembly, wherein the first and second vertical supports provide a foundation to support the awning frame substantially horizontal;

wherein the first side of the awning frame and the second side of the awning frame each comprise at least two elements joined together using an inner coupling;

wherein the awning frame comprises opposing cross members connecting the first and the second sides of the awning frame together, and each comprise at least two elements joined together using a cross member inner coupling; and wherein the awning frame further comprising a plurality of cross member connectors each having a billet and a slide, wherein the slide is secured to a respective side of the awning frame and the billet is inserted into a respective cross member.

13. The standing awning structure of claim 12, wherein the awning frame comprises tubular material and is comprised of individual components having linear dimensions no greater than four feet in length when disassembled.

14. A method of making a standing awning structure, the method comprising:

coupling together two structural elements to form a first side of an awning frame;

coupling together two structural elements to form a second side of the awning frame;

coupling together two structural elements to form a first cross member of the awning frame;

coupling together two structural elements to form a second cross member of the awning frame;

sliding a first plurality of collars over the first side of the awning frame, and sliding a second plurality of collars over the second side of the awning frame;

stretching a sheet of fabric between the first and second cross members;

coupling the first and the second cross members between the first and second sides of the awning frame;

coupling a first brace assembly having an upper end to the first plurality of collars, and connecting a second brace assembly having an upper end to the second plurality of collars;

coupling a first vertical post to a lower end of the first brace assembly, and coupling a second vertical post to a lower end of the second brace assembly, wherein the first and second vertical supports provide a foundation to support the awning frame substantially horizontal;

joining together at least two elements together using an inner coupling for each of the first side of the awning frame and the second side of the awning frame;

joining together at least two elements together using a cross member inner coupling for each of the first cross member and the second cross member; and securing a slide of a cross member connector to a respective side of the awning frame and inserting a billet of the cross member connector into a respective cross member of the awning frame.

15. The method of claim 14, wherein the awning frame comprises tubular material and is comprised of individual components having linear dimensions no greater than four feet in length when disassembled.

* * * * *